US011517503B2

(12) United States Patent
Gabele

(10) Patent No.: US 11,517,503 B2
(45) Date of Patent: Dec. 6, 2022

(54) HEATING SYSTEM FOR A SAUNA AND SAUNA WITH SUCH A HEATING SYSTEM

(71) Applicant: Klafs GmbH & Co. KG, Schwäbisch Hall (DE)

(72) Inventor: Markus Gabele, Schwäbisch Hall (DE)

(73) Assignee: Klafs GmbH, Schwäbisch Hall (DE)

( * ) Notice: Subject to any disclaimer, the term of this patent is extended or adjusted under 35 U.S.C. 154(b) by 636 days.

(21) Appl. No.: 16/555,032

(22) Filed: Aug. 29, 2019

(65) Prior Publication Data

US 2020/0121554 A1 Apr. 23, 2020

(30) Foreign Application Priority Data

Oct. 23, 2018 (DE) ..... 102018126353.8

(51) Int. Cl.
*A61H 33/06* (2006.01)
*H05B 1/02* (2006.01)
*A61H 33/00* (2006.01)

(52) U.S. Cl.
CPC ..... *A61H 33/065* (2013.01); *A61H 33/005* (2013.01); *A61H 33/063* (2013.01); *H05B 1/0297* (2013.01); *A61H 2201/0257* (2013.01); *A61H 2201/5082* (2013.01)

(58) Field of Classification Search
CPC ..... A61H 33/065
USPC ..... 219/200; 165/58; 15/250.05
See application file for complete search history.

(56) References Cited

U.S. PATENT DOCUMENTS 2,110,400 A * 3/1938 Peel ..... C08L 21/00 521/150
5,902,524 A * 5/1999 Wootten ..... B01D 53/24 264/177.14
6,246,831 B1 * 6/2001 Seitz ..... F24H 9/2021 219/483
8,505,127 B2 * 8/2013 Kim ..... A61H 33/063 4/524
10,716,192 B1 * 7/2020 Tsibulevskiy ..... H02J 7/342
2010/0077546 A1 * 4/2010 Kim ..... A61H 33/063 4/524
2010/0090534 A1 * 4/2010 Federmann ..... H02J 9/005 307/66
2013/0200063 A1 * 8/2013 Cooke ..... H05B 3/02 219/439
2013/0231791 A1 * 9/2013 Jacobs ..... G06Q 10/06 700/291
2017/0241649 A1 * 8/2017 Cave ..... H02K 7/1823
2017/0306798 A1 * 10/2017 Cave ..... F01K 7/16

FOREIGN PATENT DOCUMENTS

DE 3127691 A1 * 7/1981
DE 202012009550 U1 11/2012
DE 202013005379 U1 * 6/2013
WO 2007107621 A1 9/2007

* cited by examiner

*Primary Examiner* — Lori L Baker
(74) *Attorney, Agent, or Firm* — Dickinson Wright PLLC; Steven C. Hurles

(57) ABSTRACT

The heating system for a sauna comprises an oven and an accumulator. The heating system is electrically connectable to a mains which provides a first electrical power. The accumulator is provided to provide a second electrical power. The oven is operable with the first and second electrical powers to increase the thermal power.

15 Claims, 4 Drawing Sheets

HEATING SYSTEM FOR A SAUNA AND SAUNA WITH SUCH A HEATING SYSTEM

CROSS-REFERENCE TO RELATED APPLICATION

The present application claims priority to German Patent Application No. 102018126353.8, filed Oct. 23, 2018, the entire disclosure of which is hereby incorporated by reference.

BACKGROUND OF THE INVENTION

1. Field of the Invention

The present disclosure refers to a heating system for a sauna, and more particularly to a generic heating system that comprises an oven and an accumulator. The heating system can be used electrically with a mains which provides a first electrical power.

2. Related Art

International patent application WO 2007/107621 A1 teaches a heating system which is used in compact saunas to heat them. The accumulator serves in particular as a failure protection for the heating system or to enable its mobile use. The size of the usable volume of the sauna is limited by the power available from the mains. Especially during the heating phase of the sauna, a high heating power is necessary in order to build up the desired temperature quickly. However, in private saunas in particular, the power supply required for the oven cannot always be provided by the mains. Especially in the case of saunas that are retrofitted or extendable, the retrofitting of a preferred multi-phase alternating current connection for a sufficient energy supply of the stove is very expensive and time-consuming. Since a conventional single-phase AC connection cannot provide more than 3.7 kW of power, the size of a sauna, which can be heated sufficiently by such a stove, is limited in its volume.

SUMMARY OF THE INVENTION

The object of the present disclosure is therefore to provide a heating system that can sufficiently heat a sauna with a large volume without the need for a multi-phase AC connection.

One aspect of the present disclosure is related to a heating system which has an inventive solution of the object if the accumulator provides a second electrical power, whereby the stove can be operated with the first and second electrical power to increase the thermal power. In particular, such an oven may simultaneously receive the first power provided by the mains and the second power provided by the accumulator so that the thermal power of the oven corresponds to the sum of the first and second electrical powers. This allows the oven to be operated at a higher power without the need for a multi-phase AC connection, so that a sauna with a volume greater than 6 $m^3$ can also be operated with a single-phase AC connection. In particular, this allows the thermal power of the oven to be increased during the heating phase of the sauna, which can shorten it and reduce heat losses during this phase.

According to a particularly preferred embodiment, the first electrical power is provided by a single-phase alternating current.

In addition, the alternating current preferably has a voltage with a nominal value between 100 V and 260 V. Furthermore, the alternating current preferably has a voltage with a nominal value of 110 V or 120 V (for use in countries such as the USA or Japan) or 230 V (for use, for example, in Europe). This makes it easier to retrofit a sauna with such a heating system, as there is no need to install a multi-phase AC connection.

According to another preferred embodiment, the heating system includes a control unit, whereby the control unit is electrically connected to the mains, the accumulator and the stove. Such a control unit can be used to control the temperature of the sauna and the state of charge of the accumulator.

The control unit preferably comprises a power converter, the accumulator being electrically connected to the power converter. In a charging process of the accumulator, such a power converter converts an alternating current provided by the mains into direct current or in a discharging process of the accumulator converts a direct current provided by the accumulator into alternating current. The integration of the power converter into the control unit simplifies the replacement of the accumulator in the event of a defect.

According to another preferred embodiment, the oven can be operated at least temporarily exclusively with the first power. Especially after the heating phase, when the temperature of the sauna is kept constant, the thermal power of the oven can be reduced so that the first power provided by the mains is sufficient to maintain the temperature in the sauna. This allows the capacity of the accumulator to be limited to the energy needed to heat the sauna, thus reducing the cost of such an accumulator.

In another preferred embodiment, the oven can be operated exclusively with the second power at least temporarily. Thus the accumulator can serve as a failure protection for a heating with such a heating system.

In an additional preferred embodiment, the accumulator provides a third electrical power, whereby the third electrical power can be fed into the mains. This allows the accumulator to serve as an electrical energy storage device for a household.

In another preferred embodiment, the oven includes an evaporator. With such an evaporator, essential oils in particular can be evaporated in order to create a pleasant room climate. An evaporator also makes it possible to use a heating system for a steam bath according to the disclosure.

In another preferred embodiment, the mains has a fuse, whereby the fuse limits the first electrical power to the value of a limit power, whereby the thermal power of the oven is at least temporarily greater than the limit power. This can prevent damage to the mains caused by an excessively high first electrical power.

In an additional preferred embodiment, the control unit is connected to at least one operating element. The operating element can also be designed as a part of the control unit.

Furthermore, charging and discharging of the accumulator can preferably be regulated by the operating element. This means that before using the heating system it can be manually ensured that a sufficiently large amount of energy is stored in the accumulator.

In a further preferred embodiment, the control unit comprises at least one internal fuse. This prevents damage caused by overloading the oven, the electronics or the accumulator.

In another preferred embodiment, the control unit is at least connected to a temperature sensor. This allows the temperature in the sauna to be precisely controlled by the heating system, which creates a pleasant indoor climate.

This disclosure also discloses a sauna with a heating system, wherein the heating system comprises an oven and an accumulator and wherein the heating system corresponds to one of the previous embodiments of a heating system.

Preferably, the sauna comprises a photovoltaic system, the accumulator of the heating system being rechargeable with the photovoltaic system. In particular, such a sauna is designed as a free-standing outdoor building. The photovoltaic system enables the heating system to be operated at least temporarily independently of the mains, which reduces the electricity costs for operating the heating system. The photovoltaic system can be connected directly to the control unit of the heating system or directly to the accumulator via a separate charging device. The conversion of the direct current produced by the photovoltaic system into alternating current can be dispensed with, so that only a direct voltage converter is used to connect the photovoltaic system. Alternatively, the photovoltaic system can also be connected to the heating system via the mains, whereby an inverter is required to connect the photovoltaic system to the mains.

BRIEF DESCRIPTION OF THE DRAWINGS

An embodiment of the present disclosure will be explained in more detail below using drawings.

DETAILED DESCRIPTION OF THE ENABLING EMBODIMENT

Figure 1:
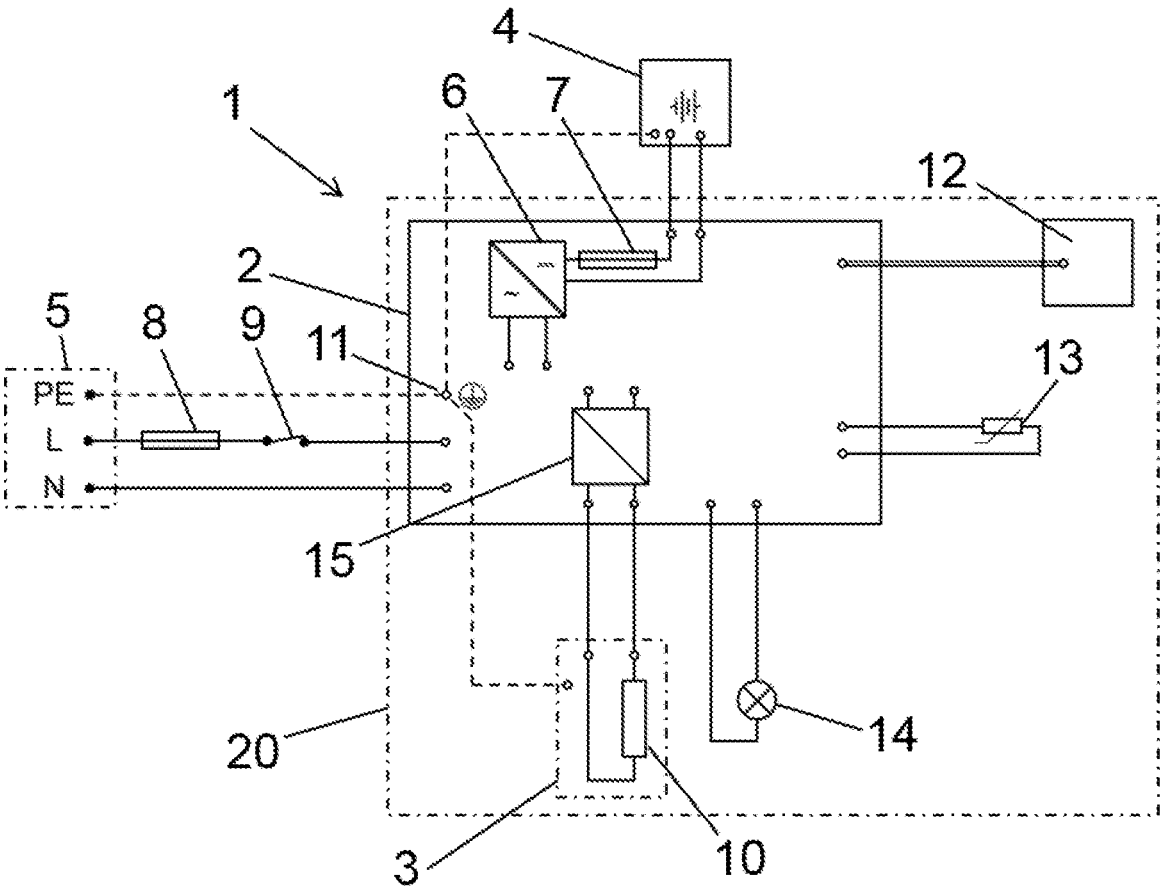
FIG. 1 shows a diagrammatic plan for the electronic design of a heating system 1 according to disclosure.

As shown in FIG. 1, the heating system 1 includes a control unit 2, wherein the control unit 2 is connected to the mains 5. For example, the mains 5 may have an AC voltage with an effective value of 230V. The first electrical power supplied by the mains 5 and consumed by the heating system 1 corresponds to the product of the effective value of the alternating voltage and the effective value of the current consumed. The mains 5 is a single-phase AC mains, so that the control unit is connected to the mains 5 via a three-core cable. The three-core cable comprises an outer conductor L, a middle conductor N and a protective conductor PE. The first power provided by the mains 5 is limited to the value of a limit power by a first fuse 8. The first fuse 8 is advantageously fitted to the outer conductor L. To safely switch off the heating system 1, the electrical connection to the mains 5 can be separated by a main switch 9. The main switch 9 is attached to the outer conductor L, but can advantageously also interrupt the middle conductor N. For additional protection against electric shocks, the heating system 1 is connected to the PE protective conductor via an earth connection 11 of control unit 2. It is advantageous that the earth connection 11 is also connected to the accumulator 4 and the oven 3, so that at least the housing of the accumulator 4 and the housing of the oven 3 are voltage-free.

The oven 3 comprises at least one heating element 10, which converts a fourth electrical power into thermal power to heat the sauna 20. The fourth electrical power required for this is regulated by power electronics 15 of control unit 2. The oven 3 is operated with an alternating current. The stove 3 advantageously includes an additional evaporator, whereby the evaporator is either suitable for evaporating essential oils to create a pleasant indoor climate in the sauna 20, or is suitable for increasing the humidity inside the sauna 20, so that the sauna 20 can also be used as a steam bath.

The control unit 2 is connected to at least one operating element 12. The operating element 12 enables the exact setting of the room temperature of the sauna 20, its time course, the humidity in the sauna 20, the desired heating curve of the stove 3 and/or the charging behavior of the accumulator 4. Advantageously, the operating element 12 includes a touch-sensitive screen.

To monitor the room temperature of the sauna 20, the control unit 2 is connected to at least one temperature sensor 13. If the sauna 20 is suitable for use as a steam bath, a hygrometer can also be connected to control unit 2.

A lamp 14 is also connected to the control unit for lighting the interior of the sauna 20 and is supplied with electrical power by the control unit. Switching lamp 14 on and off can be controlled using operating element 12.

The accumulator 4 is connected to the control unit 2, wherein the accumulator is advantageously located outside the sauna 20 in order to protect the accumulator 4 from overheating due to the high temperatures inside the sauna 20. For further protection against overloading and overheating, the accumulator is connected to at least one second fuse 7. The second fuse 7 limits the amount of the second electrical power, which is given by the product of the cell voltage of the accumulator and the current of the charging current or the discharging current of the accumulator 4. The accumulator 4 is also connected to a converter 6 of the control unit 2, whereby the converter 6 converts the alternating current provided by the mains 5 or the alternating current required to operate the oven 3 into a direct current.

Figure 2A:
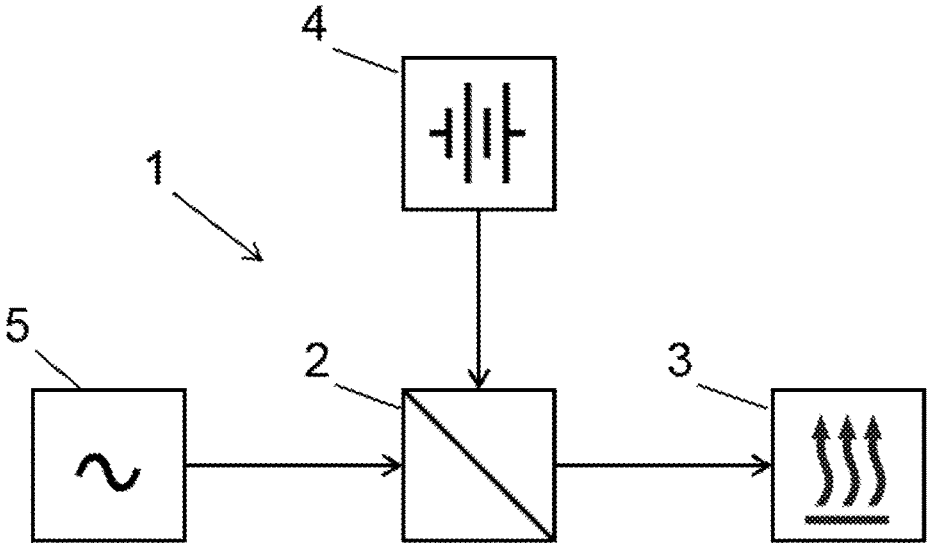
FIGS. 2A, 2B, 2C, 2D, and 2E show five different modes of operation for the heating system 1 according to the disclosure.

A first function of the heating system 1 is shown in FIG. 2*a*. The mains 5 provides a first electrical power and the accumulator 4 a second electrical power, both of which are consumed by the control unit 2. The control unit 2 supplies the oven 3 with a fourth electrical power, whereby the fourth electrical power is essentially given by the sum of the first electrical power and the second electrical power. However, a portion of the first or second electrical power may also be used to operate the lamp 14, the operating element 12 or the temperature sensor 13, the value of that portion being negligible in relation to the fourth power.

This first mode of operation is used in particular during a heating phase of the sauna 20, wherein the thermal power delivered by the oven 3, which corresponds to the amount of the fourth electrical power, is higher than the limit power of the first fuse 8. This allows a sauna 20 connected to a single-phase AC mains 5 to be operated with a higher thermal power than the AC mains 5 can provide, so that a sauna 20 with a larger volume can be heated. As the maximum thermal power required to heat up the sauna 20 is reached, it is necessary to use the second electrical power of the accumulator 4, especially during the heating up phase.

Figure 2B:
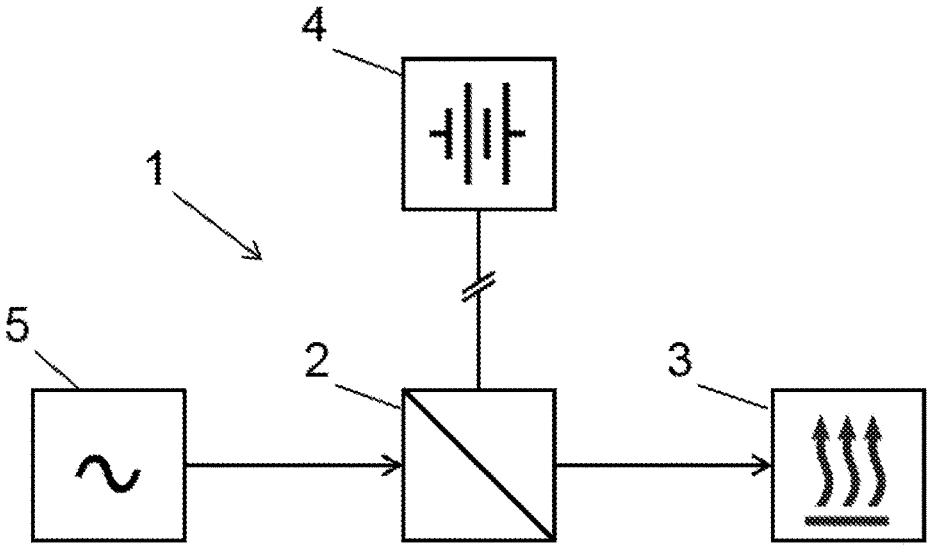

A second function of the heating system 1 is shown in FIG. 2*b*. The accumulator 4 does not provide a second electrical power, so that only the first power provided by the mains 5 is used to operate the stove 3. This second mode of operation is used in particular in a continuous operation phase or at least in a phase directly following the heating phase of the sauna 20. This allows the capacity of the accumulator 4 to be designed in such a way that the stored energy content of the accumulator 4 is essentially used up after the end of the heating phase.

Figure 2C:
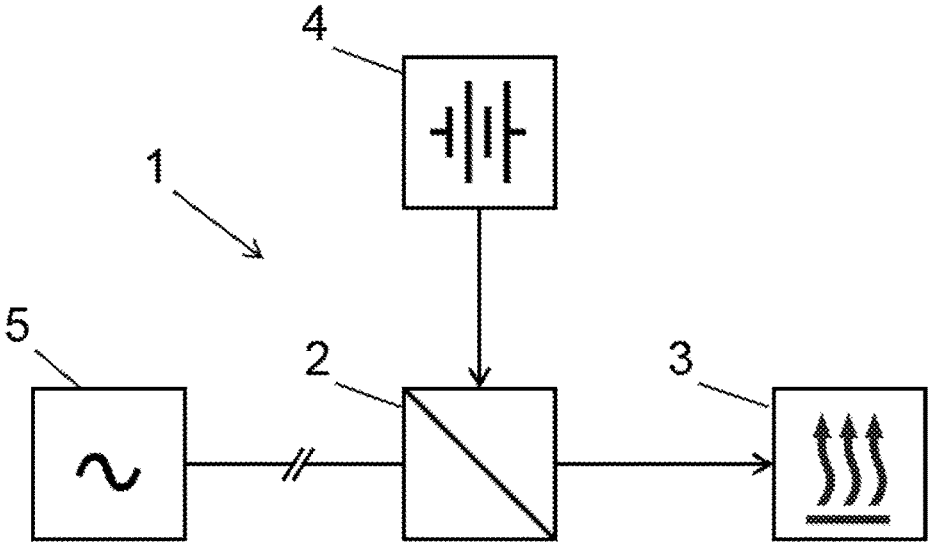

A third function of the heating system 1 is shown in FIG. 2*c*. The mains 5 does not provide any first electrical power, so that the stove 3 is operated exclusively with the second electrical power provided by the accumulator 4. This third function serves in particular the supply of a failure safety device for the heating system 1. Thus an immediate failure of the heating system 1 can be prevented in particular in the case of a power failure.

Figure 2D:
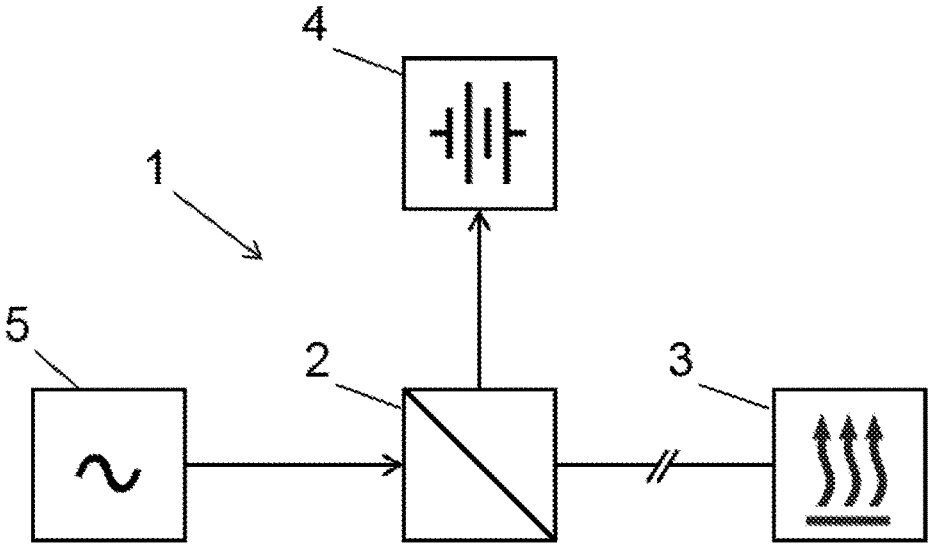
Figure 2E:
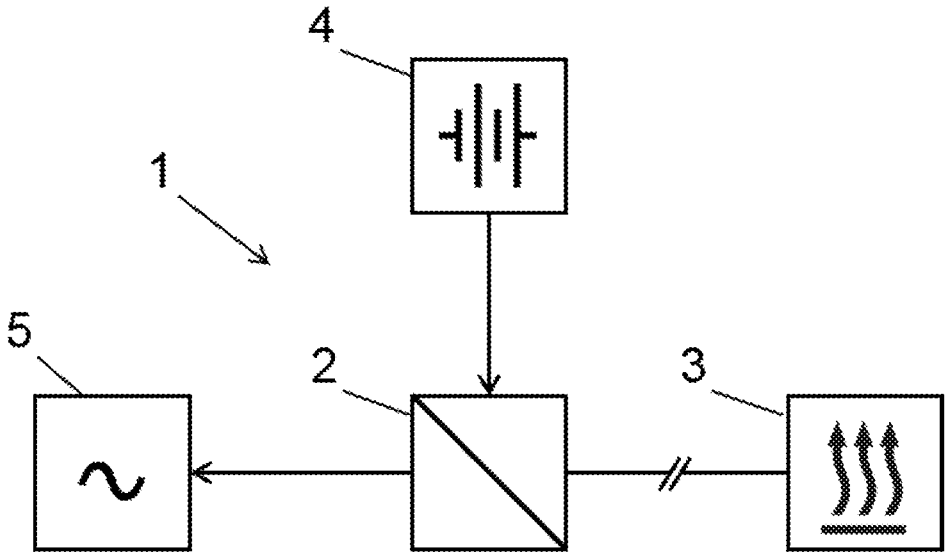

A fourth function of the heating system 1 is shown in FIG. 2*d*. The oven 3 is switched off so that it does not consume a fourth electrical power. The first electrical power provided by the mains 5 is used in this fourth mode to charge the accumulator 4. This fourth function is used in particular in one phase after the sauna 20 has finished operating to recharge the accumulator 4 for reheating the sauna 20.

A fifth function of the heating system 1 is shown in function 2*e*. The accumulator 4 provides a third electrical power, whereby the third electrical power is fed into the power supply system 5 by the control unit 2. The oven 3 is switched off. This fifth function of the heating system 1 makes it possible to use the accumulator 4 as a power storage device. The energy content of the accumulator 4 can be recharged by a charging process according to the fourth function of the heating system 1, or by a photovoltaic system of the sauna 20. This fifth function can be used to store renewable energy, especially outside the operation of the sauna 20.

The person skilled in the art will see that the disclosure is not limited to the above embodiment. The accumulator 4 can also be placed inside the sauna 20 using suitable insulation. In addition, the person skilled in the art will see that the sauna 20 can be designed either as a built-in sauna for a living room or as a free-standing separate building.

What is claimed is:

1. A heating system for a sauna, the heating system being electrically connectable to a mains that provides a first electrical power and comprising:

an oven, an accumulator that provides a second electrical power, and wherein the oven is operable with the first and second electrical powers to increase a thermal power.

2. The heating system according to claim 1, wherein the first electrical power is provided by a single-phase alternating current.

3. The heating system according to claim 2, wherein the alternating current has a voltage with a nominal value of between 100 V and 260 V.

4. The heating system according to claim 1, further including a control unit, the control unit being electrically connected to the mains, the accumulator and the oven.

5. The heating system according to claim 4, wherein the control unit comprises a converter, the accumulator being electrically connected to the converter.

6. The heating system according to claim 1, wherein the oven can be operated at least temporarily exclusively with the first electrical power.

7. The heating system according to claim 1, wherein the oven can be operated at least temporarily exclusively with the second electrical power.

8. The heating system according to claim 1, wherein the oven comprises an evaporator.

9. The heating system according to claim 1, wherein the mains has a fuse, the fuse limiting the first electrical power to the value of a limit power, the thermal power of the oven being at least temporarily greater than the limit power.

10. The heating system according to claim 1, wherein a control unit is connected to at least one operating element.

11. The heating system according to claim 10, wherein charging and discharging of the accumulator can be regulated by the operating element.

12. The heating system according to claim 10, wherein the control unit comprises at least one internal fuse.

13. The heating system according to claim 10, wherein the control unit is connected to at least one temperature sensor.

14. A sauna comprising a heating system, the heating system comprising an oven and an accumulator, wherein the heating system is a heating system according to claim 1.

15. The sauna according to claim 14, further including a photovoltaic system, the accumulator being chargeable with the photovoltaic system.

* * * * *